US009564111B2

(12) United States Patent
Hankins

(10) Patent No.: US 9,564,111 B2
(45) Date of Patent: Feb. 7, 2017

(54) GUITAR STAND

(71) Applicant: Mark W. Hankins, Houston, TX (US)

(72) Inventor: Mark W. Hankins, Houston, TX (US)

( * ) Notice: Subject to any disclaimer, the term of this patent is extended or adjusted under 35 U.S.C. 154(b) by 0 days.

(21) Appl. No.: 14/976,012

(22) Filed: Dec. 21, 2015

(65) Prior Publication Data

US 2016/0111070 A1 Apr. 21, 2016

(51) Int. Cl.
*G10G 5/00* (2006.01)

(52) U.S. Cl.
CPC ..... *G10G 5/00* (2013.01)

(58) Field of Classification Search
CPC ..... G10G 5/00
See application file for complete search history.

(56) References Cited

U.S. PATENT DOCUMENTS 2,502,229 A * 3/1950 Miller ..... F16M 11/14 248/168
3,664,224 A * 5/1972 Campagna, Jr. ..... G10H 3/18 248/230.8
3,680,820 A * 8/1972 Gracie ..... G10G 5/00 248/314
3,765,633 A * 10/1973 Caudill ..... G10G 5/00 24/457
4,084,778 A * 4/1978 Dominguez ..... G10G 5/00 248/300
4,176,580 A * 12/1979 Gallegos ..... G10G 5/00 248/224.51
4,345,732 A * 8/1982 Gallegos ..... G10G 5/00 248/201
4,546,688 A * 10/1985 Cuccio ..... G10G 5/00 248/205.1
4,991,809 A * 2/1991 Harkey ..... G10G 5/00 248/229.12
5,031,868 A * 7/1991 Thomas, II ..... G10G 5/00 248/283.1
5,116,005 A * 5/1992 LaGoy ..... F16M 11/22 248/168
5,197,701 A * 3/1993 Olson ..... G10G 5/00 248/166
5,313,866 A * 5/1994 Smith ..... G10G 5/00 248/121
5,346,168 A * 9/1994 Astrella ..... G10G 5/00 248/113
5,372,346 A * 12/1994 Upchurch ..... F16B 21/04 248/222.52
6,464,189 B1 * 10/2002 Yu ..... G10G 5/00 248/221.11
6,481,677 B1 * 11/2002 Yu ..... A47F 5/083 211/59.1
7,259,310 B2 * 8/2007 Wilfer ..... G10G 5/00 248/110
7,446,249 B2 * 11/2008 Driscoll ..... G10G 5/00 84/327
7,484,701 B2 * 2/2009 Hsieh ..... A47F 5/0853 211/106.01

(Continued)

*Primary Examiner* — Robert W Horn
(74) *Attorney, Agent, or Firm* — Tumey L.L.P.

(57) ABSTRACT

A guitar support stand includes a mounting plate that is attachable to a stable support such as a musical piece of equipment having a substantial weight. A guitar support member is releasably attached to the mounting plate and includes at its upper end a support bracket for supporting the neck portion of a guitar.

13 Claims, 4 Drawing Sheets

(56) References Cited

U.S. PATENT DOCUMENTS

| | | | | |
|---|---|---|---|---|
| 7,579,537 | B2 * | 8/2009 | Lippert | G10G 5/00 84/327 |
| 8,038,109 | B2 * | 10/2011 | Ashford | G10G 5/00 248/150 |
| 8,055,008 | B1 * | 11/2011 | Davis | G10G 5/00 381/120 |
| 8,701,900 | B2 * | 4/2014 | Childers | G10G 5/00 181/199 |
| 9,305,529 | B1 * | 4/2016 | Paounov | G10G 5/00 |
| 2005/0000348 | A1 * | 1/2005 | Workman | G10G 5/00 84/327 |
| 2007/0001081 | A1 * | 1/2007 | Wallis | G10G 5/00 248/312 |
| 2010/0032535 | A1 * | 2/2010 | Elliott | B25H 3/006 248/229.22 |
| 2014/0224948 | A1 * | 8/2014 | McEwan | G10G 5/00 248/163.1 |
| 2016/0027416 | A1 * | 1/2016 | Hsu | G10G 5/00 248/121 |

* cited by examiner

GUITAR STAND

BACKGROUND OF THE INVENTION

Field of the Invention

This application relates to a stand for supporting a guitar. The stand includes a mounting plate that is attachable to a piece of musical equipment such as an amplifier. A vertical support member is releasably attached to the mounting plate and includes at its upper end a bracket which may be U-shaped for supporting the guitar by engaging the upper neck portion of the guitar.

Background of the Invention

Guitars are quite often expensive musical instruments that can be easily damaged if not handled properly. Frequently when a musician is playing a guitar it is necessary to find a convenient place to temporarily support the guitar to prevent damage. Sometimes whether on stage or during practice the guitar is merely placed against an object such as an amplifier for support and is susceptible to damage. It is also known to use a hook member that may be attached to a block of wood that can be mounted off a vertical surface. This support requires a vertical surface of sufficient height and does not provide for a suitable cushioning for the lower body of the guitar.

Consequently, there is a need for a guitar support that is adapted to be secured to a readily available vertical support surface and also that is steady and has a provision for cushioning and supporting the lower portion of a guitar.

BRIEF SUMMARY OF SOME OF THE PREFERRED EMBODIMENTS

An embodiment of the present invention includes a mounting plate that is attachable to a heavy piece of equipment that is normally present while playing an electric guitar, for example an amplifier which includes a cabinet, speakers, and electronics. The mounting plate includes a plurality of securing devices for supporting a plurality of rods located at a lower end of a support member.

The support member has a vertically adjustable upper portion that includes a support bracket. The lower end of the support member includes one or more cushions for engaging the lower portion of the guitar.

The support bracket is adapted to fit under the headstock of the guitar and the cushions engage and support the backside of the body of the guitar. The support member may be slightly inclined with respect to the vertical.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
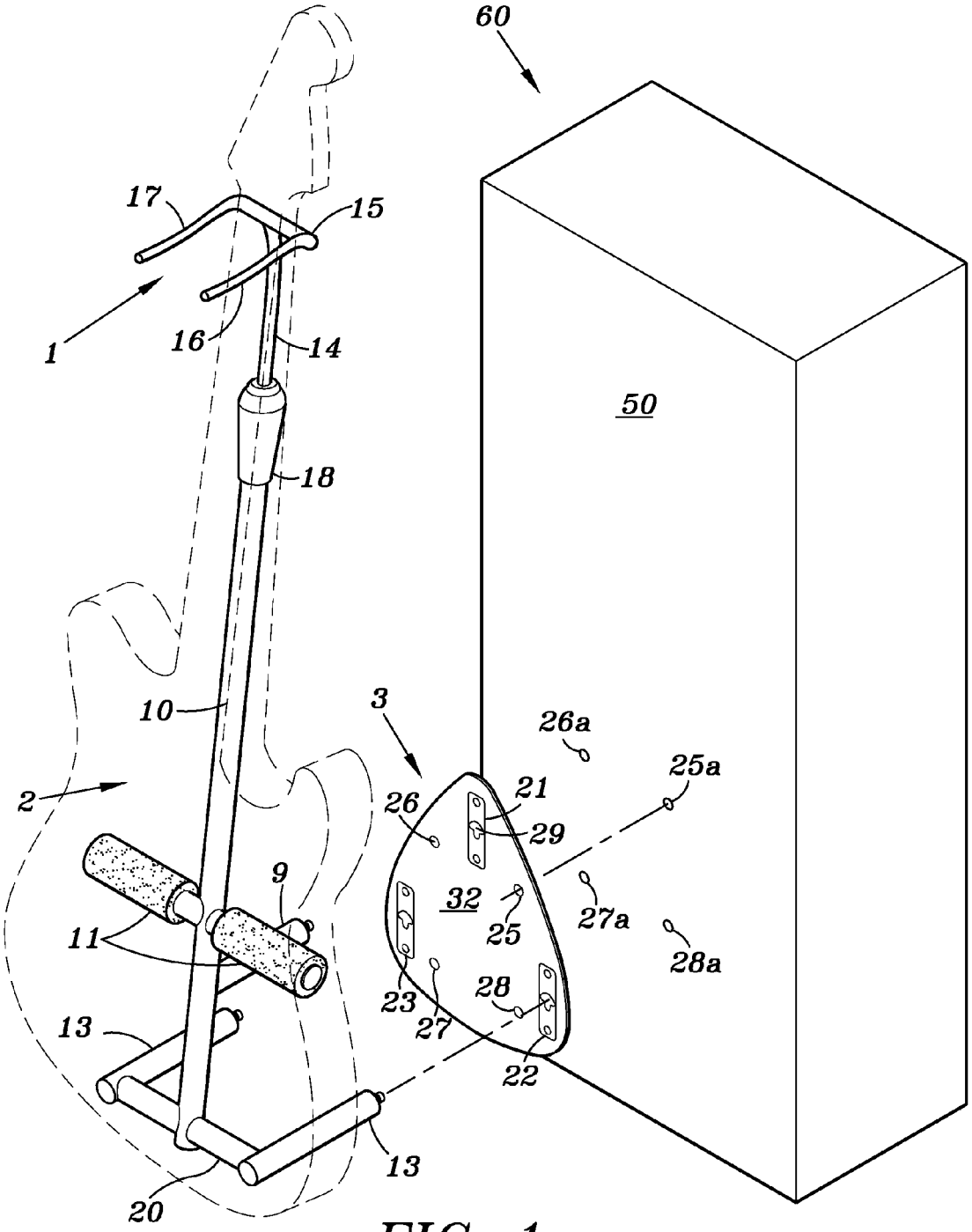
FIG. 1 illustrates an exploded view of the support member, mounting plate and a musical device such as an amplifier.

Referring to FIG. 1, an embodiment of the invention includes a mounting plate 3 which is adapted to be secured to a musical component such as an amplifier 60 having a wall 50. Musical component 60 should be of sufficient weight so as to provide a sturdy support for support member 2.

Support member 2 is adapted to be releasably mounted on mounting plate 20 in a manner described below. Support member 2 includes a bracket having arms 16 and 17 which support the upper neck portion of a guitar.

Figure 2:
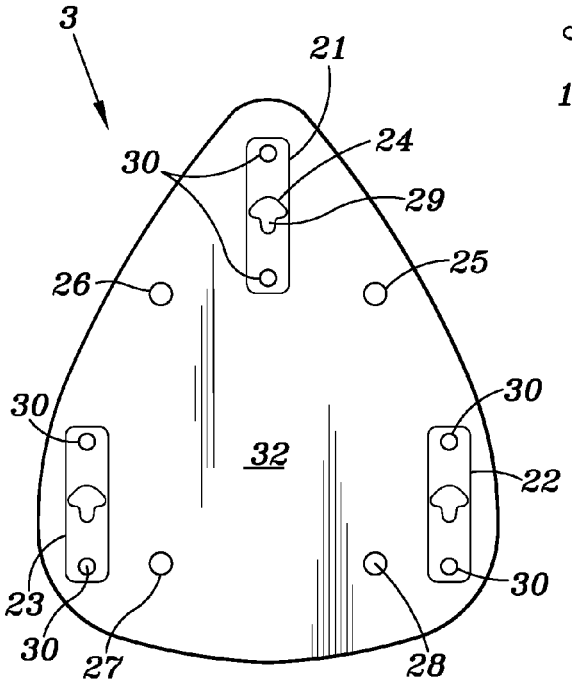
FIG. 2 illustrates a front view of the mounting plate.

As shown in FIG. 2, mounting plate 3 has a generally triangular shape with curved sides. It resembles the shape of a guitar pick. The mounting plate includes a flat surface 32 having a plurality of holes 25-28 which allow the mounting plate to be secured to amplifier 50 by a plurality of screws, for example. Pre- drilled holes 25*a*-28*a* may be provided in musical component 50 for this purpose. The mounting plate could be secured to the amplifier by any well-known securing means or an adhesive.

Figure 5:
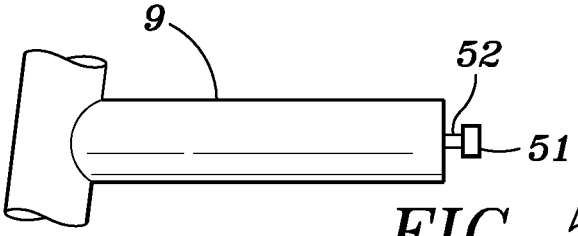
FIG. 5 illustrates the pin corrector at the end of a connector rod.

Mounting plate 3 includes a plurality of mounting elements 21, 22, and 23 which are of the type that includes a slot having a wide opening 24 and a narrow slot 29 which together are adapted to receive a pin like member 52 having an enlarged head 51 attached to the pin as shown in FIG. 5. These mounting elements are well known in the art as keyhole brackets.

As shown in FIG. 2, three such mounting elements are attached by suitable attachment means such as screws 30 to mounting plate 3.

Figure 3:
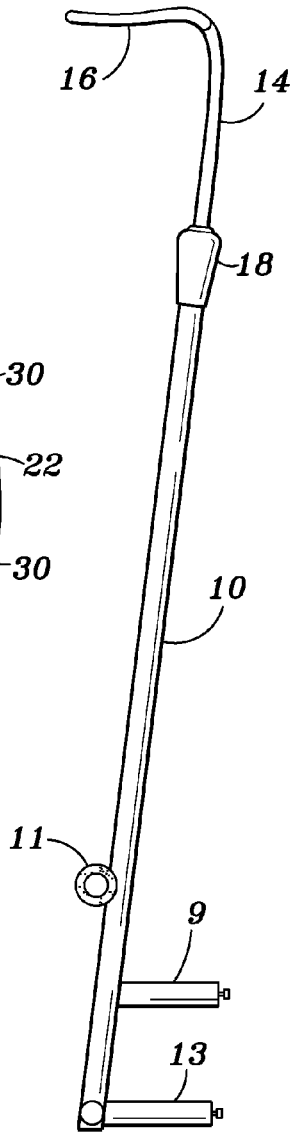
FIG. 3 illustrates a side view of the support member.
Figure 4:
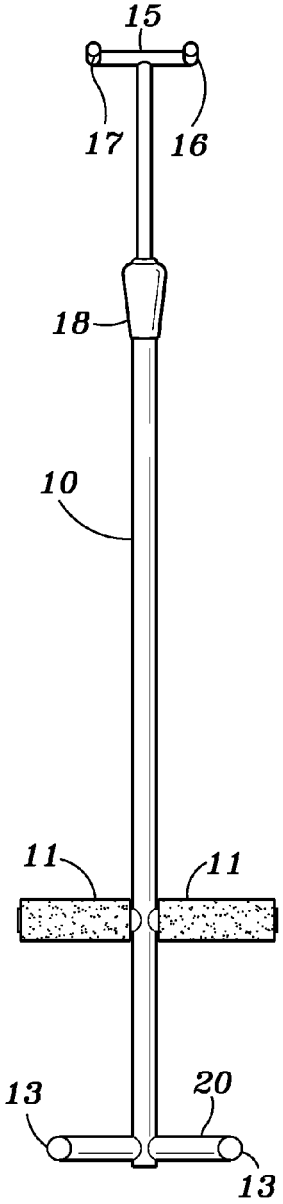
FIG. 4 illustrates a front view of the support member.

The guitar support member 1 as shown in FIGS. 1, 3, and 4 includes a first support rod 10. At the lower end of rod 10, a pair of cushions 11 are supported. Also at the lower end, three connector rods extend outwardly of the support rod 10. Two connector rods 13 are positioned on the ends of a cross brace 20 that is attached to support rod 10. A third connector rod 9 extends outwardly of support rod 10.

Each of the connector rods 9 and 13 includes at an end a pin including an enlarged head 51 and a smaller shaft 52 as shown in FIG. 5. These pins are adapted to be attached to the mounting elements 21, 22, and 23 in a known manner.

Guitar support member 2 includes an upper bracket 1 which is telescopically received in support rod 10.

A compression fitting 18 allows for vertical adjustment of bracket 1 in a known manner.

Support bracket 1 includes a pair of arms 16 and 17 mounted on cross brace 15 and a shaft 14. Members 15, 16, and 17 could also be formed as a single piece rod bent in the manner shown in FIG. 1. Arms 16 and 17 are spaced apart so as to support the upper neck portion of a guitar shown in phantom in FIG. 1.

As shown in FIG. 3, rod 10 and bracket 1 may be slightly inclined with respect to the vertical. In this manner, when the neck of a guitar is placed on arms 16, 17 the rear portion of the body of a guitar 2 will rest on cushions 11.

In use, the mounting plate 3 is fixedly attached to a sidewall 50 of musical component 60. Guitar support member 1 is then attached to the mounting plate by inserting enlarged heads 51 into openings 24 of the attachment members 21-23. The three pins attached to rods 9 and 13 then slide down slot 29 shown in FIG. 2 in a known manner to releasably attach guitar support member 2 to mounting plate 3. Guitar support member 2 can be easily removed from mounting plate 3 simply by vertically raising the guitar support member.

Figure 6:
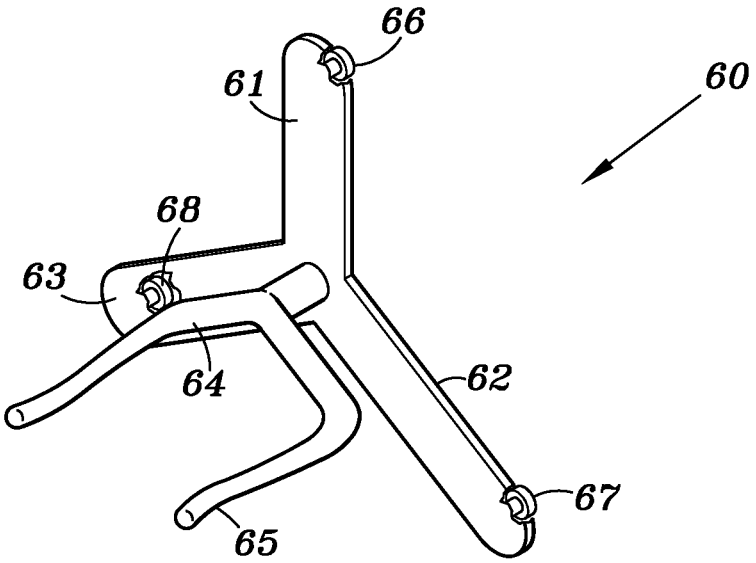
FIG. 6 is a perspective view of a second embodiment of the invention.
Figure 7:
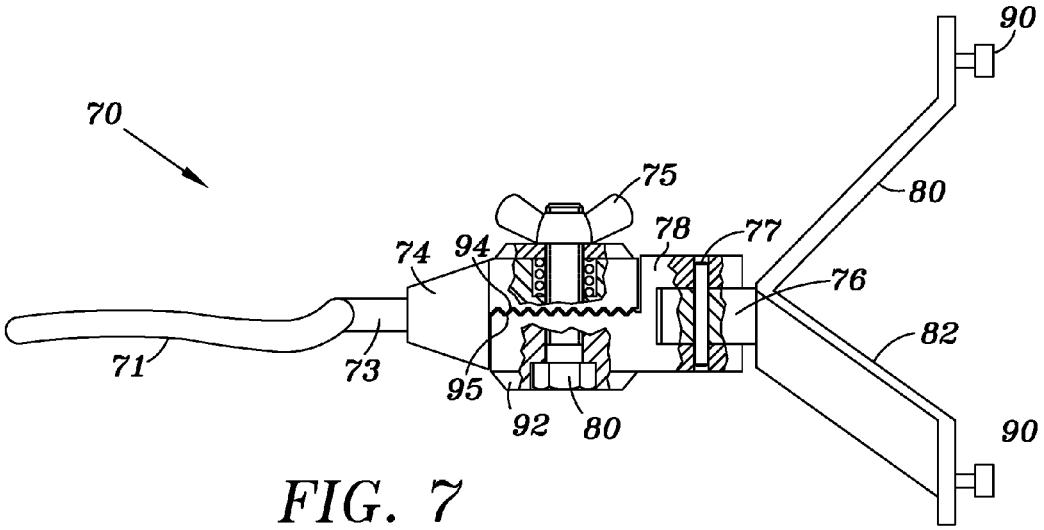
FIG. 7 is a side view of a further embodiment of the invention.
Figure 8:
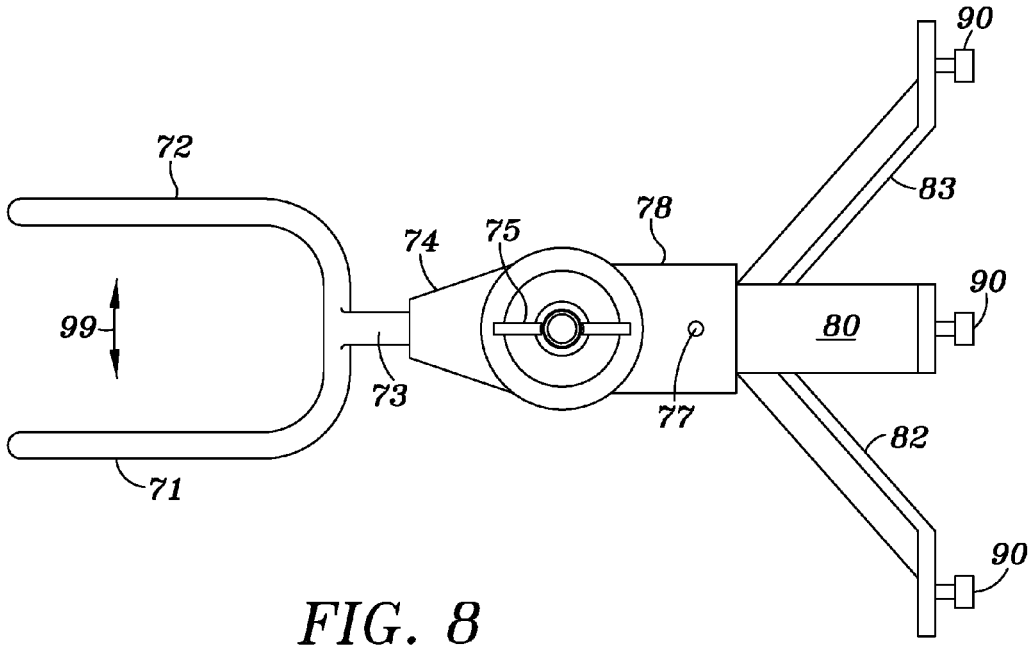
FIG. 8 is a top view of the embodiment of FIG. 7.

FIGS. 7 and 8 illustrate another embodiment of the invention. The bracket 70 of this embodiment includes three legs 82, 83, and 80 each having a connector pin 90 similar to the arrangement shown in FIG. 6. At the junction of the three legs, a support stud 76 extends outwardly. A lower bracket body 78 is pivotally connected to support stand 76 by a pin 77. An upper bracket body 74 having a central section 73 and a pair of supporting arms 72, 71 is adjustably and rotatably connected to the lower bracket body by a wing nut 75, bolt 80 and serrations 94, 95 as is known in the art. In this manner, the horizontal orientation of support arms as shown by arrows 99 can be adjusted once the bracket 70 is attached to a support such as mounting plate 32 which in turn may be attached to a musical component 50.

The triangular shape of the mounting plate along with the provision of the three connector rods for supporting the support member create an extremely sturdy yet convenient guitar support stand that may easily be disassembled.

FIG. 6 illustrates a second embodiment of the invention. A bracket 60 includes three legs 61, 62 and 63 connected together and having connector pins 66, 67, and 68. The bracket also includes arms 64, 65 secured to legs 61, 62 and 63 that are adapted to support the neck portion of a guitar. The bracket can be secured to a mounting plate 32 by pins 66, 67, 68 that slide within slots 29 to secure the bracket to the mounting plate in the manner shown in FIG. 1.

Although the present invention and its advantages have been described in detail, it should be understood that various changes, substitutions and alterations may be made herein without departing from the spirit and scope of the invention as defined by the appended claims.

What is claimed is:

1. A guitar support stand comprising:

a) a mounting plate adapted to be attached to a musical component, the mounting plate including a plurality of mounting elements, b) a guitar support member having an upper end and a lower end, c) a plurality of connector rods extending from a lower portion of the guitar support member and adapted to be connected to the mounting elements of the mounting plate, and d) a bracket positioned at the upper end of the guitar support member, the bracket being adapted to support a neck portion of a guitar.

2. The guitar support stand as claimed in claim 1 further including a pair of cushions extending laterally of the guitar support member and adapted to support a rear portion of a guitar body.

3. The guitar support stand as claimed in claim 1 wherein the bracket is telescopically received in a rod, and means for adjusting the vertical position of the bracket with respect to the rod.

4. The guitar support stand as claimed in claim 1 wherein the connector rods have a pin extending from an end of the rod, the pin including an enlarged head and a smaller shaft.

5. The guitar support stand as claimed in claim 1 wherein the mounting plate is generally triangular in shape and a mounting element is positioned adjacent each vertex of the triangle.

6. The guitar support stand as claimed in claim 5 wherein the mounting plate is generally in the shape of an isosceles triangle.

7. The guitar support stand as claimed in claim 4 wherein the mounting elements have a slot adapted to receive the pin extending from an end of the connector rod.

8. The guitar support stand of claim 1 wherein the support member is inclined with respect to the vertical when attached to the mounting plate.

9. The guitar support stand of claim 1 wherein the mounting elements and the connector rods are three in number.

10. A support for a guitar comprising:

a) a plurality of legs connected together and including a connector pin at one end of each leg, and b) a bracket having a pair of arms secured to the legs at a position where the legs are connected together.

11. The support for a guitar as claimed in claim 10 further including a mounting plate having a plurality of mounting elements for receiving the connector pins at the end of the legs.

12. The support of claim 10 further including a support stud connected to the three legs, wherein the bracket is pivotably connected to the support stud.

13. The support of claim 10 wherein the bracket includes a lower bracket body and an upper bracket body pivotably and adjustably connected to the lower bracket body.

* * * * *